US007854325B2

(12) United States Patent
Bentele

(10) Patent No.: US 7,854,325 B2
(45) Date of Patent: Dec. 21, 2010

(54) CHILDPROOF PACKAGE

(75) Inventor: Josef Bentele, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 99 days.

(21) Appl. No.: 12/412,792

(22) Filed: Mar. 27, 2009

(65) Prior Publication Data

US 2009/0255832 A1 Oct. 15, 2009

(30) Foreign Application Priority Data

Apr. 14, 2008 (EP) ..... 08007318
Oct. 2, 2008 (EP) ..... 08165756

(51) Int. Cl.
*B65D 83/04* (2006.01)
*A45C 13/12* (2006.01)

(52) U.S. Cl. ..... 206/531; 206/1.5; 206/539; 206/468; 220/345.3; 229/125.125

(58) Field of Classification Search ..... 206/1.5, 206/528, 530, 531, 538, 539, 468; 220/345.1–345.5, 220/348; 229/125.125
See application file for complete search history.

(56) References Cited

U.S. PATENT DOCUMENTS 4,126,224 A 11/1978 Laauwe et al.
4,561,544 A 12/1985 Reeve
5,275,291 A * 1/1994 Sledge ..... 206/531
6,976,576 B2 * 12/2005 Intini ..... 206/1.5
2005/0183981 A1 * 8/2005 Gelardi ..... 206/531
2007/0261984 A1 * 11/2007 Gelardi ..... 206/531
2008/0257773 A1 * 10/2008 Gelardi ..... 206/1.5
2009/0152134 A1 * 6/2009 Katsis ..... 206/1.5
2009/0178948 A1 * 7/2009 Reilley et al. ..... 206/531

FOREIGN PATENT DOCUMENTS

GB 2 042 476 9/1980
WO WO 01/35772 5/2001
WO WO 03/101840 12/2003
WO WO 2005/102849 11/2005

* cited by examiner

*Primary Examiner*—Luan K Bui
(74) *Attorney, Agent, or Firm*—Cohen, Pontani, Lieberman & Pavane LLP

(57) ABSTRACT

A childproof package includes a package housing, two guide recesses, which are formed in an area of an inside surface of the package housing, and a sliding element for a package content. The sliding element has two projections on its top or bottom surface, which are guided in the guide recesses. Further, the childproof package has a spring element arranged between the package housing and the sliding element. The projections can be latched by the elastic force of the spring element in notches, which extend from the guide recesses and branch off from it, and can be released against the elastic force of the spring element so that the projections are returned to the guide recesses.

15 Claims, 6 Drawing Sheets

CHILDPROOF PACKAGE

BACKGROUND OF THE INVENTION

1. Field of the Invention

The invention pertains to a childproof package, especially a childproof sliding-insert package for pharmaceutical products. The package is essentially rectangular and comprises a drawer, which is pushed into a package housing, from which it can be pulled out again to open the package.

2. Description of the Related Art

So that children cannot open these types of packages and gain unsupervised access to the contents, the lawgiver has imposed certain rules which state that the packages must be designed to be childproof. It should therefore be impossible for children to open such packages in their as-delivered state, that is, in the unopened state, and also impossible for them to open them again after they have been reclosed. For this reason, childproof packages are provided with opening mechanisms which children cannot usually identify or operate.

For example, a childproof sliding-insert package with a housing and a drawer is described in WO 03/101840 A1, in which a stop tab is formed on the inside surface of each of the two long sides of the housing. These stop tabs engage with openings formed in the surface of the long sides of the drawer and thus prevent the drawer from being pulled out. By placing two fingers, e.g., the thumb and index finger, in the two holes formed in the long sides of the housing and pressing on the long sides of the drawer, these long sides can be deformed, i.e., bent inward, to such an extent that the stop tabs are disengaged from the openings. There will thus be no locking action in effect as the drawer is being pulled out simultaneously in the opening direction.

The disadvantage of this design is that, as a result of the deformation of the drawer, its holding space is reduced and/or the material filling the holding space is pushed aside as well. It is possible furthermore, to see the opening mechanism through the holes, which means that it would be possible even for children to recognize how the package is being held shut and to open it despite the precautions taken to prevent such action. The design also offers an opening mechanism with a relatively low degree of difficulty.

SUMMARY OF THE INVENTION

It is an object of the present invention to provide an improved childproof package, which comprises a more complicated safety mechanism and in which the safety mechanism results in little or no impairment to the holding space.

According to one aspect of the invention, the childproof package includes a package housing, at least one guide recess, which is formed in an area of an inside surface of the package housing, a sliding element to hold a package content, the sliding element comprising at least one projection on a top or bottom surface, the at least one projection being guided in the at least one guide recess, and at least one spring element, which is arranged between the package housing and the sliding element, wherein each projection can be latched by the elastic force of the spring element in a notch, which extends from the guide recess and branches off from it, and can be released against the elastic force of the spring element so that the projection is returned to the guide recess and can be guided in the guide recess.

Because of the guidance in the guide recess, it is possible to control the movement of the sliding element in the package housing. Thus, for example, the package can be designed so that the sliding element can be pulled completely out or so that it can be pulled out only up to a certain point.

The sliding element can be pulled out preferably by exerting pressure in a transverse direction of the package against the elastic force of the spring element and by simultaneously pulling the sliding element in the opening direction. As a result, a locking or opening mechanism can be provided which is effective without occupying a great deal of space.

In the normal case, openings are provided in the long sides of the package for the direct application of a force from the side onto the sliding element. It is also possible, however, to provide press-in spots which do not have openings. The child safety is thus increased even more, because the closed package does not give children any clues as to how it can be opened.

It is advantageous for at least one spring element to be located on one side of the sliding element. This lateral position will provide an especially effective mechanical locking effect if the direction in which the spring acts and the direction in which the sliding element is to be opened are offset 90° from each other.

The package preferably comprises two spring elements. Thus, if the two spring elements are arranged so that they are perpendicular to each other in the plane of the sliding element, for example, the degree of difficulty of the locking or opening mechanism can be increased. In this case, the only way to unlock the sliding element is to exert pressure on the package housing not just in one but two directions which are perpendicular to each other.

It is also advantageous for the package housing to comprise two guide recesses and for the sliding element to comprise two projections. It is thus possible to design the locking and opening mechanism with two stages and thus to make it even safer.

The two projections will normally be arranged with an offset from each other in the opening direction of the sliding element.

The package preferably comprises two openings or press-in spots, which can be pressed simultaneously or in sequence to release the sliding element. As a result, an especially safe design of the inventive package is possible, especially if, to release the sliding element, it is necessary to press on two spots in sequence rather than simultaneously. Thus, after the user has released the sliding element by actuating the first projection-spring-guide recess combination, he will push the sliding element a certain distance in the opening direction until the second projection in the second guide recess strikes a stop. Then he must press on the second opening or press-in spot, so that the second projection-spring-guide recess combination can finally release the sliding element completely. By increasing the number of locking mechanisms, the complexity and thus the child safety of the inventive package can be improved even more.

The package housing and the sliding element will usually be made of cardboard, molded film, injection-molded plastic, or foam material.

It is advantageous for the guide recess to be formed in an insert arranged in the package housing. If the insert is made of material which is stronger than the material of the package housing, it will be possible to fulfill even higher safety requirements.

It is also advantageous for the guide recess to be integrated into the bottom or top area of the package housing. As a result, it is possible to save material and to simplify the manufacturing process.

It is especially advantageous for the sliding element to be designed as a drawer, and for the package content to be a heat-sealed blister pack. The package content in such case may also be a clamped-together package, which may be sealed as well. In these cases, the content is preferably attached firmly to the drawer. As a result, a medication blister pack, for example, cannot be removed from the drawer and therefore cannot be lost. The inventive package is especially childproof if the drawer cannot be pulled completely out of the package housing, and this will be the case if the guide recesses have no open ends in the opening direction of the package.

Alternatively, the sliding element itself can be designed as a blister pack, wherein tablets or similar individual products can serve as the package content of the blister pack. In this case, an especially simple design is provided, which requires only a few components.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described in greater detail below with reference to the exemplary embodiments illustrated in the figures.

DETAILED DESCRIPTION OF THE PREFERRED EMBODIMENTS

Figure 1:
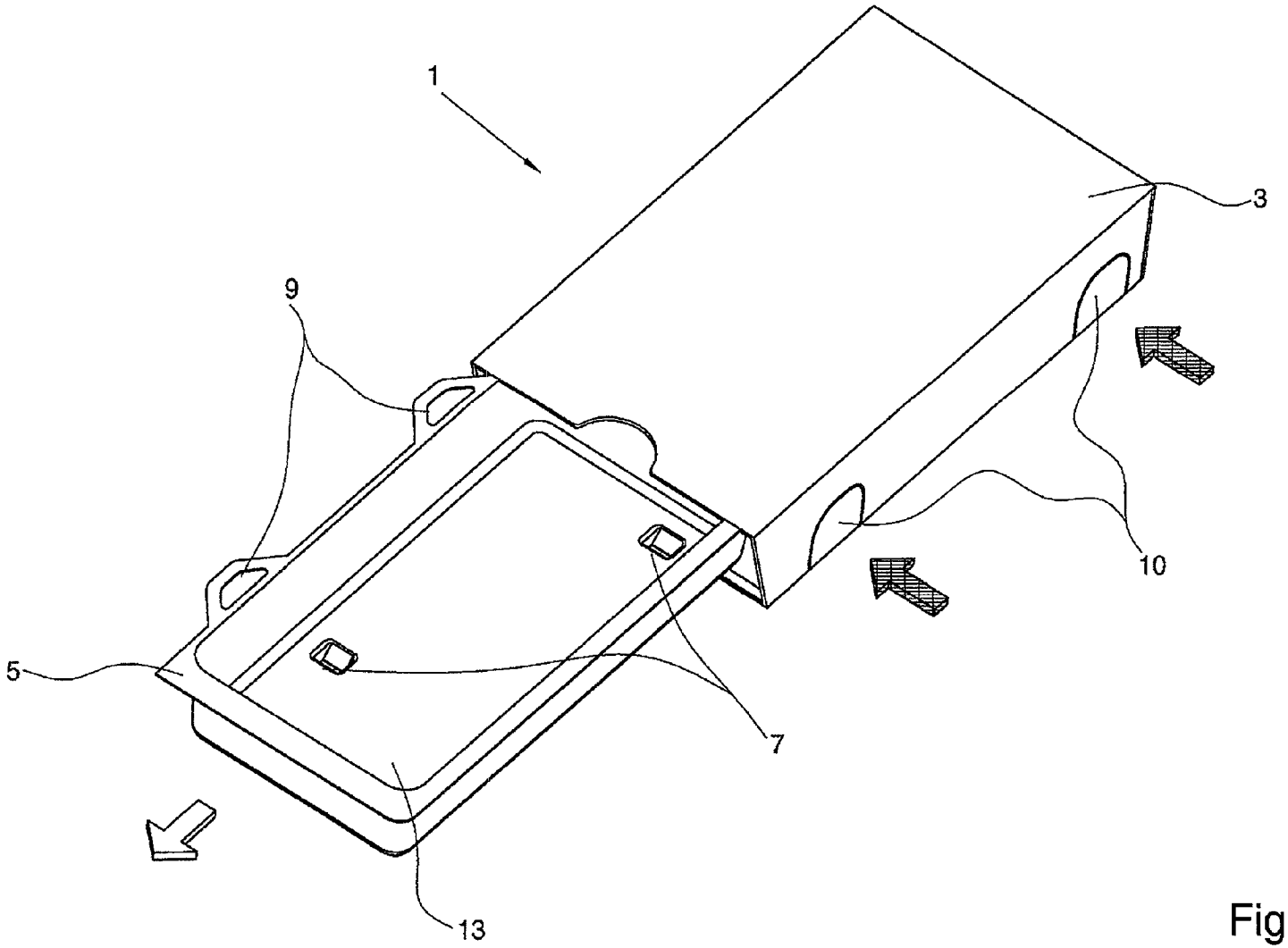
FIG. 1 is a perspective view of a first embodiment of the invention.

FIG. 1 is a perspective view of a first embodiment of the invention. The rectangular box-shaped package 1 comprises a package housing 3, in which a sliding element 5 designed as a drawer is placed so that it can be pulled out. This drawer holds the content of the package (not shown in this figure). In the bottom area of the drawer 5, projections 7 are formed, which engage in guide recesses, to be described later in greater detail, which are formed on the inside surface of the bottom of the package housing 3. The drawer 5 also has two spring elements 9, which, when the package 1 is closed, are located between the side wall of the package housing 3 and the drawer 5 in a pretensioned state.

In the embodiment shown here, two press-in spots 10 are formed on one of the long sides of the package housing 3. These press-in spots 10 are characterized as such by an imprint on the package housing 3. In addition, embossed areas on the long sides can identify the location of the press-in spots 10. Alternatively, the press-in spots 10 can be designed as depressions or openings in the package housing 3.

Figure 2:
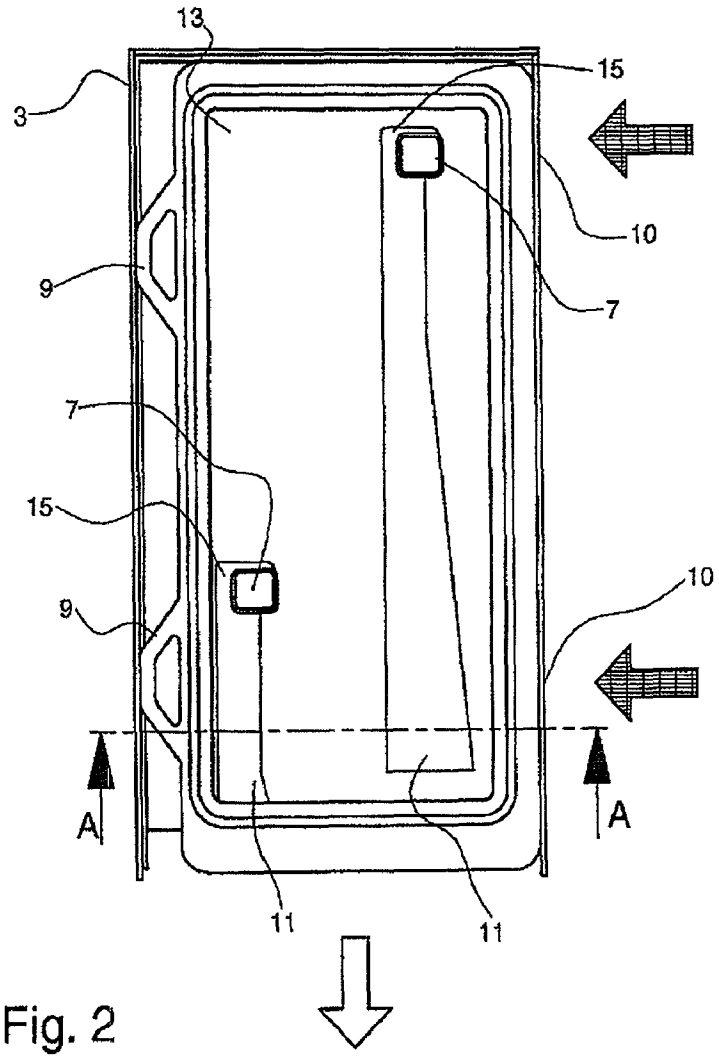
FIG. 2 is a top view of the embodiment of FIG. 1, wherein, for the sake of clarity, some of the components have been omitted.

FIG. 2 is a top view of the embodiment according to FIG. 1, wherein, for explanatory purposes, the top of the package housing 3 has been removed and the bottom of the drawer 5 is transparent. In addition to the components already described in reference to FIG. 1, we can now see two guide recesses 11, each of which comprises a notch 15 at their inner ends. The area of the drawer which can be used to hold the package content is bounded by the line forming the inner loop.

Figure 3:
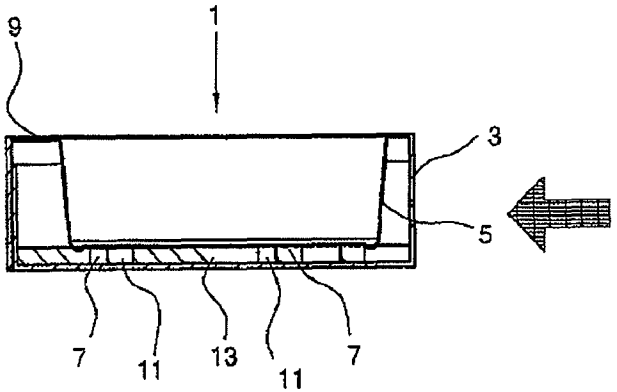
FIG. 3 is a cross-sectional view of the embodiment according to FIG. 1.

FIG. 3 is a cross-sectional view of the embodiment of the inventive package 1 illustrated in FIGS. 1 and 2 with a modified spring element 9. Inside the package housing 3, we can see the drawer 5, characterized by thick, solid lines, on which the spring element 9 is located (in the area on the left in the drawing). The bottom area 13 is shown shaded and comprises two guide recesses 11, in which the two projections 7 engage for guidance.

In the following, the way in which the inventive package functions will be described on the basis of FIGS. 1-3. In addition to the components previously described, all of the above figures comprise arrows, which are important for the explanation of the package's function. The unfilled arrow shows the opening direction of the package 1, that is, the direction in which the drawer 5 is pulled out of the package housing 3. The filled arrows show the direction of the force which must be exerted to unlock the safety mechanisms of the inventive package. The filled arrows in the figures are called "unlocking arrows" in the following, whereas the unfilled arrows are referred to below as "opening arrows".

In the closed state, the drawer 5 is located entirely within the package housing 3. The projections 7 formed in the bottom area of the drawer 5 are held in notches 15, which are formed in the bottom area of the interior of the package housing 3. Between the left long side of the package housing 3 and the drawer 5, two spring elements 9 are formed, which, in the embodiment shown in FIGS. 1-3, are designed as elastic tabs of cardboard material made as integral parts of the drawer. When the package 3 is closed, the two spring elements 9 are in the compressed state, and the elastic force thus exerted presses the drawer toward the right. The two projections 7 are thus pressed into the notches 15 formed at the inner ends of the guide recesses 11. The projections 7 come to rest against the stops resulting in the area of the notches 15 and latch themselves in place there, thus ensuring that the drawer 5 is locked to the package housing 3.

To open the package 1, that is, to pull the drawer 5 locked by the latched projections 7 out of the package housing 3, pressure must be exerted in opposition to the elastic forces of the spring elements 9, as a result of which the projections 7 are disengaged from the notches 15 and introduced into the guide recesses 11. This is done in the embodiment shown here by pressing on the press-in spots 10 or openings, which are located on the long right side of the package housing 3. In the embodiment shown here, the press-in spots 10 are designed as depressions, into which one can put two fingers simultaneously. Various other designs of the press-in spots are also possible, however. For example, something can simply be printed onto the package to indicate the exact spot where pressure must be exerted in opposition to the elastic forces of the spring elements 9. An opening could also be provided at these spots in the package housing 3. When one now presses simultaneously on the two press-in spots 10 with two fingers, for example, the projections 7 are disengaged from the notches 15 and free to move in the opening direction, so that pulling simultaneously in the opening direction moves the drawer 5 out of the package housing 3. Once the projections 7 are in the guide recesses 11, there is no longer any need to continue to exert pressure on the press-in spots 10 in the unlocking direction, because the projections are no longer locked in position and are now merely being guided along the guide recesses 11. The drawer 5 can be pulled out in the opening direction until one of the projections, here the right projection 7, strikes the outer end of the right guide recess 11 and causes the opening movement to stop. In this opened state, it is now possible to remove the content from the drawer 5.

In an alternative embodiment, the two guide recesses 11 do not stop before they reach the end of the package housing 3 but rather extend all the way to the end, as a result of which the drawer 5 can be pulled completely out of the package housing 3.

Pushing or reintroducing the drawer 5 back into the package housing 3 has the effect that, as a result of the guidance of the projections 7 in the guide recesses 11, more and more force must be exerted in opposition to the elastic action of the spring elements 9 until the projections 7 reach the notches 15 at the end of the guide recesses 11 and latch themselves in place there under the action of the elastic force. Thus the childproof package of the invention is again in the closed state. The package is childproof, because it takes a relatively high level of physical coordination to apply the forces in the unlocking and opening directions, which, in the embodiment shown here, are offset 90° from each other, and to coordinate the timing with which these forces are applied.

FIGS. 4*a*-4*e* are schematic diagrams of various embodiments of the locking mechanism of the invention, wherein, for the sake of simplicity, only the following components are illustrated: the drawer 5 (with transparent bottom), the projection 7, the spring element 9, the guide recess 11, the notch 15, and the unlocking and opening arrows.

Figure 4D:
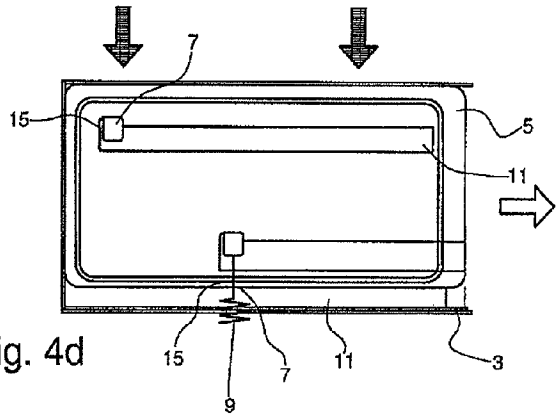
FIGS. 4*a*-4*e* are schematic diagrams of various embodiments of the locking mechanism of the invention.
Figure 4E:
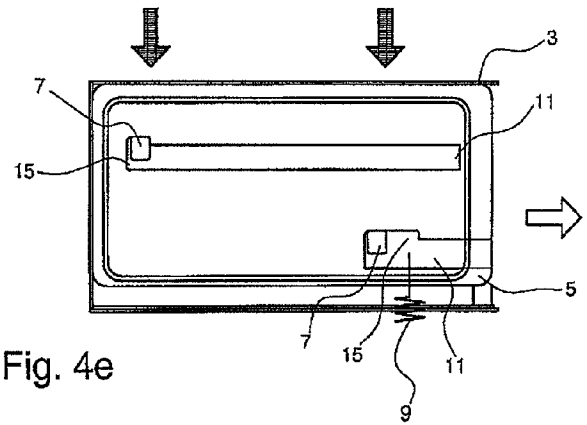
Figure 4A:
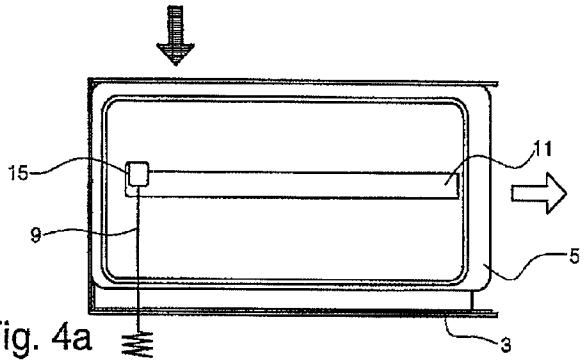

FIG. 4*a* shows a simple embodiment of the inventive locking mechanism with a projection 7 formed on the drawer 5; with a guide recess 11, which has no open end in the opening direction; and with a notch 15 formed at the inner end of the guide recess 11. In the lower left of the diagram, a spring element 9 is arranged, which is connected to the drawer 5. The exertion of a force against the force of the spring element 9 in the unlocking direction (indicated by the filled arrow) disengages the projection 7 from its latching position in the notch 15, and simultaneously pulling on the drawer 5 in the opening direction, which is perpendicular to the unlocking direction, moves the drawer 5 out of the package housing 3 (not shown).

Figure 4B:
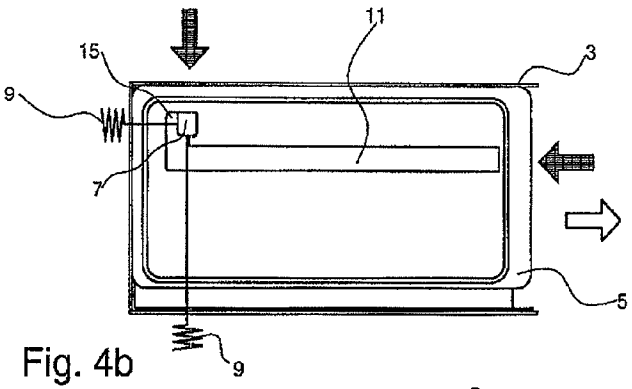

FIG. 4*b* shows the same elements as FIG. 4*a* but also a second spring element 9, which is arranged on an end surface of the drawer. Also in contrast to FIG. 4*a*, the notch 15 has two stops arranged perpendicular to each other, so that the projection 7 latches itself and is held in place by the elastic forces of both springs 9, wherein the elastic forces are offset from each other by 90°. To disengage the projection 7 completely from its latched position, the unlocking mechanism requires the exertion of two forces, each one in opposition to the elastic force of one of the spring elements 9, in one case perpendicular to the opening direction (as in FIG. 4*a*) and in the other case in the direction opposite the opening direction. In the embodiment shown here, therefore, it is necessary to execute a multi-stage unlocking and opening operation: first, it is necessary to press against the first spring element 9 in the direction opposite the opening direction while simultaneously or shortly thereafter pressing in the direction opposite the elastic force of the second spring element 9 perpendicular to the opening direction. Only then will the projection 7 be disengaged from the latching position in the notch 15. Finally, the entire drawer 5 can be pulled out in the opening direction. It is obvious that each of the unlocking forces must be exerted only until the projection 7 has been disengaged from its locked position and the drawer 5 has been moved a short distance in the opening direction.

Figure 4C:
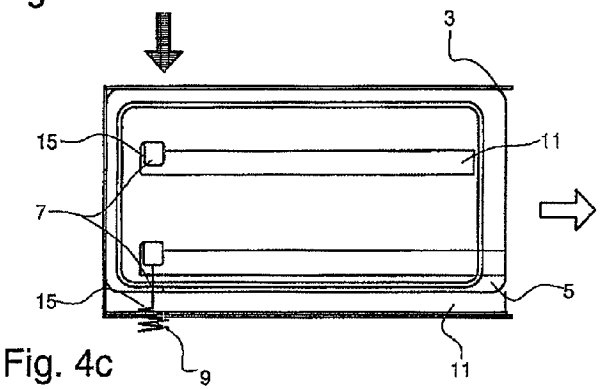

FIG. 4*c* shows another embodiment of the locking mechanism, wherein two projections 7 are formed on the drawer 5, each of which is guided in its own guide recess 11. As in the case of the embodiment of FIG. 4*a*, only one spring element 9 is present. The way in which the embodiment illustrated here functions is nearly the same as that shown in FIG. 4*a*, the difference being that pressure in opposition to the elastic force of the spring element 9 in the unlocking direction moves both projections 7 out of their notches 15 and thus unlocks them. The advantage of the embodiment shown here in comparison with that of FIG. 4 is that, if one of the projections 7 does not latch properly, the correct latching of the other one can take over the safety function.

An elaboration of the embodiment shown in FIG. 4*c* is the embodiment of FIG. 4*d*. The only difference is that the projections 7 on the drawer 5 are offset from each other in the opening direction, and one guide recess 11 is correspondingly shorter than the other. This has the effect that pressure must be exerted against the elastic force of the spring element 9 at two different positions on the long side to disengage both projections 7 simultaneously from their locking position in the notches 15. The locking and opening mechanism of this embodiment is more complicated than that of FIG. 4*c*, and for this reason it offers a higher degree of child safety.

FIG. 4*e* shows another refined embodiment. The difference from the embodiment shown in FIG. 4*d* is that, although only one is shown, a separate spring element 9 can be present for each projection 7; in addition, one notch 15 is larger than the other by a predetermined amount in the opening direction of the drawer 5. As a result, an additional, multi-stage unlocking and opening mechanism is created, which functions as follows: First, the inner projection 7 is disengaged from its latching position by the exertion of an appropriate unlocking force. Immediately thereafter, it is possible to pull the drawer 5 out by a predetermined distance until the second projection 7 comes to rest against the second notch 15. To disengage this lock, it is necessary to exert an unlocking force against the elastic force of the second spring element 9 and simultaneously to pull the drawer 5 out in the opening direction. With this mechanism, the complexity of the inventive childproof package is increased yet again.

The skilled person will see that additional projections, spring elements, guide recesses, and notches can be provided according to the invention in suitable fashion in order to realize even more highly sophisticated locking and opening mechanisms of the inventive package.

Figure 5A:
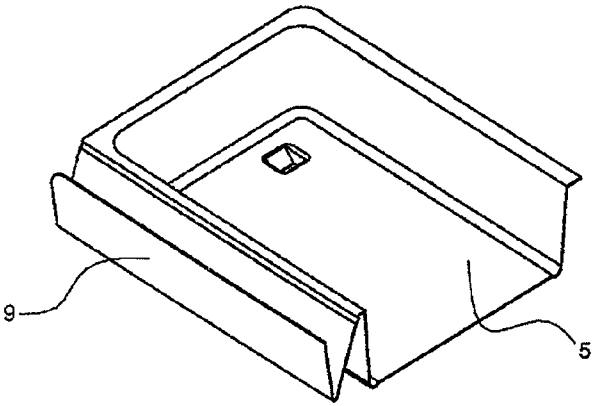
FIGS. 5*a*-5*d* are schematic diagrams of various embodiments of the spring element of the invention.
Figure 5B:
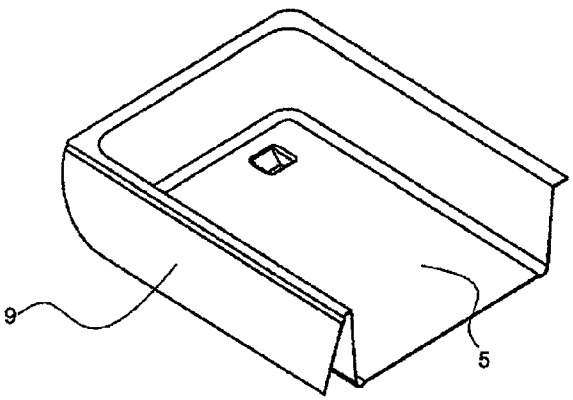
Figure 5C:
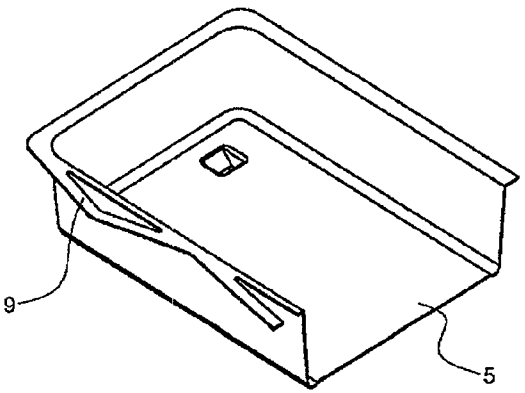
Figure 5D:
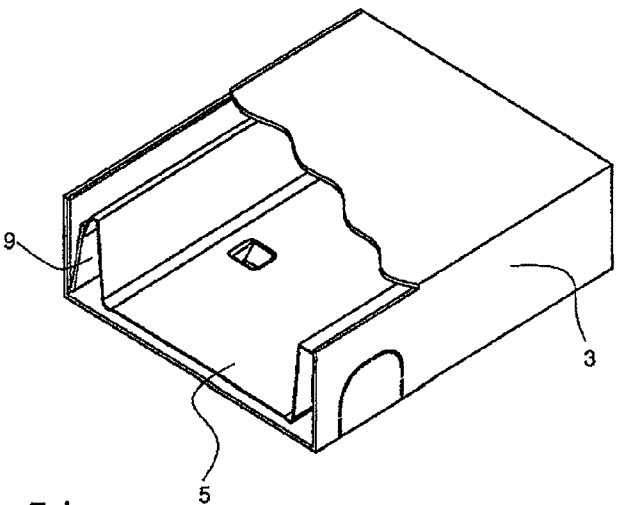

FIGS. 5*a*-5*d* show exemplary embodiments of the spring elements 9. The spring elements shown here can be easily produced, for example, from cardboard material as integral parts of the drawer 5. FIG. 5*a* shows a spring element 9 of the folding bellows type; FIG. 5*b* shows a spring element 9 which consists of a longitudinally folded tab; FIG. 5*c* shows two arc-shaped or bail-shaped spring elements 9; and FIG. 5*d* shows a spring element 9 which is formed as a longitudinally folded, arc-shaped cardboard tab.

The expert will see that there are many other design possibilities available for the spring elements 9. For example, the spring elements 9 can be arranged as separate parts between the package housing 3 and the drawer 5. Any suitable materials of any suitable shape can be used for the spring elements, e.g., metal or plastic spring elements.

FIGS. 6*a*-6*d* are schematic diagrams of various other modifications of the inventive package, wherein each of the drawers 5 holds a different type of package content.

Figure 6C:
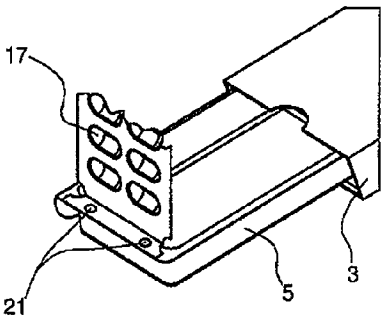
FIGS. 6*a*-6*e* are schematic diagrams of various embodiments of the inventive package with its content.
Figure 6B:
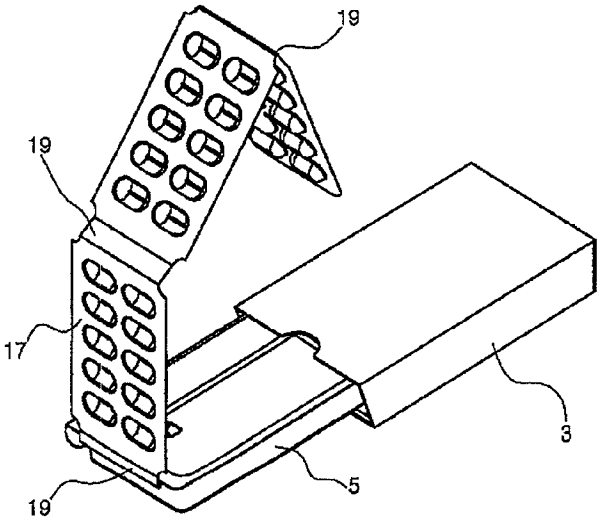
Figure 6A:
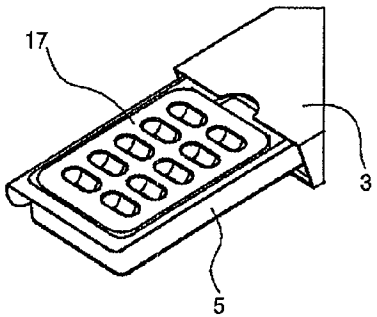

FIG. 6*a* is a perspective view of an embodiment of the inventive package in which a standard commercial blister pack 17 is present in the drawer 5, which has been pulled more than half-way out of the package housing 3. The blister pack 17 is laid loosely in the drawer 5.

FIG. 6*b* shows a schematic cross-sectional view of a drawer 5 of the inventive package, wherein a folded blister pack 17 is connected by a film hinge 19 to the drawer 5. The blister pack is thus connected directly to the drawer 5 and thus offers the possibility of being unfolded to allow removal of the medications. After being folded back up again as an integral part of the drawer 5, it can be pushed back into the package housing 3.

FIG. 6*c* shows a variant of the embodiment illustrated in FIG. 6*b*, in which the blister pack 17 is welded at a point 21 to the drawer 5. Any suitable welding method can be used for this welding operation such as ultrasonic welding.

Figure 6E:
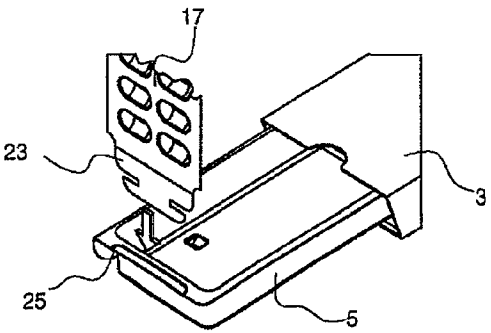
Figure 6D:
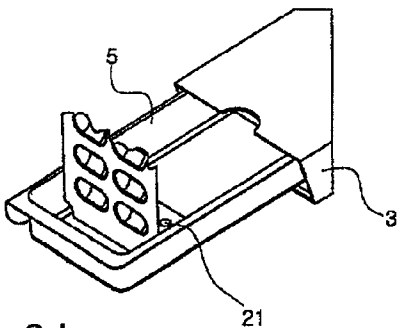

FIG. 6*d* shows another embodiment of the inventive package, in which the blister pack 17 is connected at one end to the bottom area of the drawer 5 (by ultrasonic welding, for example). In the embodiment shown here, the blister pack 17 is shown in the unfolded state.

FIG. 6*e* shows another embodiment of the inventive package, in which the blister pack 17, like the embodiments of FIG. 6*b* and 6*c*, has at one end an insertion tab 23, which can be inserted into a corresponding opening 25 formed in the edge of the drawer 5.

Numerous other possibilities exist for arranging the package content in the drawer of the inventive package, depending on the materials selected for the drawer, for the package housing, and for the package content. Examples of package content include syringes, ampoules, vials (small bottles for perfume samples, for example), needles, surgical implements, scalpels, and the like, which can be sterilized, if desired, and made available in the inventive package.

A wide variety of possibilities is also available for the detailed design of the guide recesses and notches. It is logical that the guide recesses 11 should extend essentially in the opening direction of the sliding element, but they can also run at a slant, so that the pretension of the spring element 9 is increased as the sliding element is pushed in (see FIG. 2).

The guide recesses 11 can be integrated either into the bottom area or into the top area of the package housing 3, or they can be formed on an additional insert, which is connected to the bottom or top area of the package housing.

Figure 7:
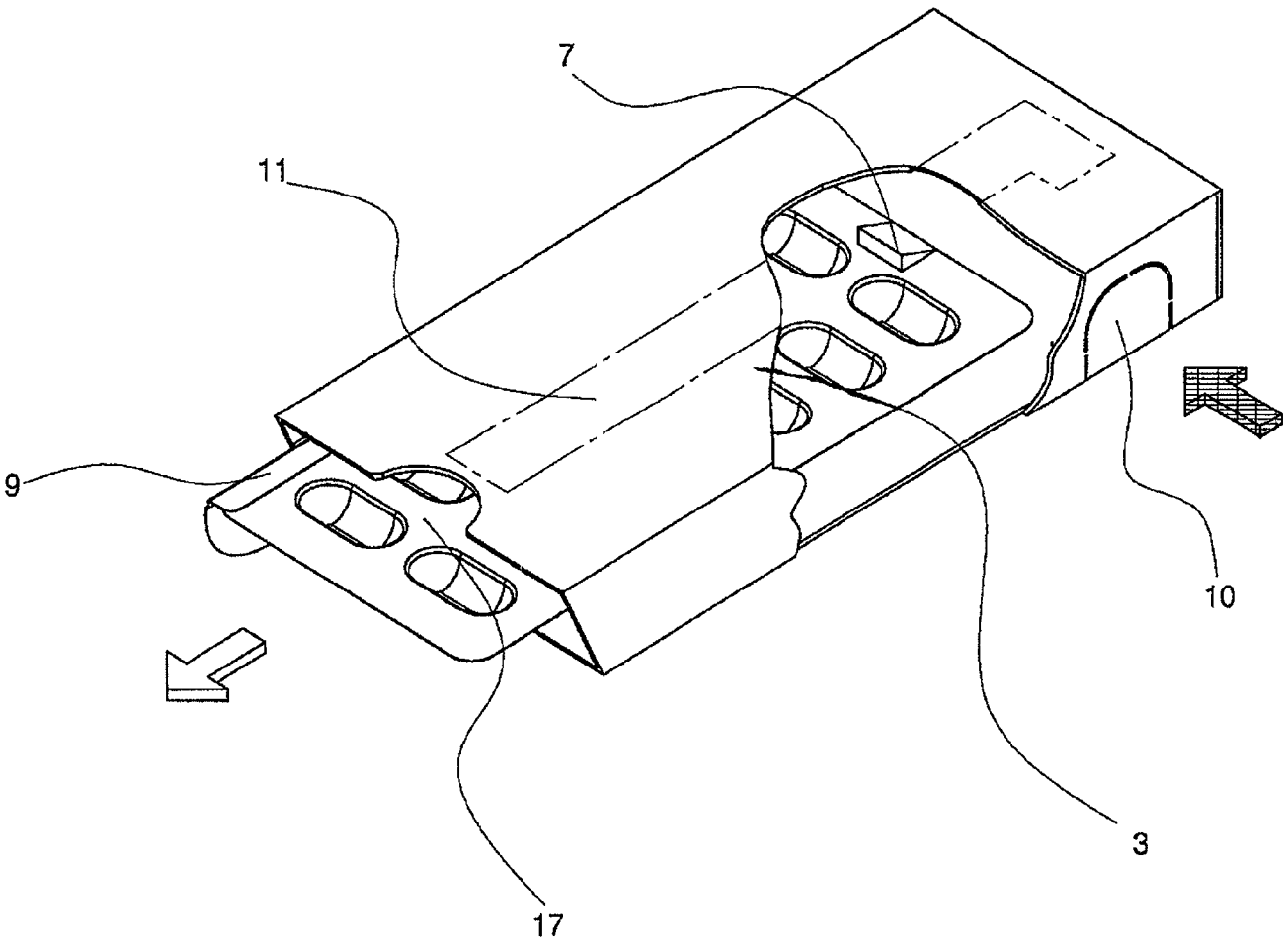
FIG. 7 is a perspective view of another embodiment of the inventive childproof package.

FIG. 7 is a partially cut-away perspective view of another preferred embodiment, of especially simple design, of the inventive childproof package. Here the sliding element is designed as a blister pack 17, which is pushed into the package housing 3 and comprises blister pockets to hold content such as tablets. In this embodiment, the inside surface of the package housing cover comprises the guide recess 11. The projection 7 formed on the top side of the blister pack 17 is guided in the guide recess 11. The exertion of pressure on the press-in spot 10 on the side of the package housing 3 acts on the blister pack 17 and thus on the spring element 9, which is formed on the side of the blister pack 17 situated opposite the press-in spot 10. The spring element 9 can be formed as an integral part of the blister pack 17, or it can be connected to it in a nonpositive manner by gluing, welding, or some other suitable method. The locking and opening mechanism is similar to the mechanism described with reference to FIG. 4*a*, wherein the blister pack 17 represents the sliding element instead of the drawer 5.

The inventive subject matter provides a childproof package comprising a complex safety mechanism, where the safety mechanism subjects the content holding space to little or no impairment.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A childproof package comprising a package housing;

at least one guide recess, which is formed in an area of an inside surface of the package housing;

a sliding element to hold a package content, the sliding element comprising at least one projection on its top or bottom surface, the at least one projection being guided in the at least one guide recess; and at least one spring element, which is arranged between the package housing and the sliding element, wherein the at least one projection is latchable by an elastic force of the at least one spring element in at least one notch, which extends from the guide recess and branches off from it, and is releasable against the elastic force of the at least one spring element so that the at least one projection is returned to the at least one guide recess.

2. The childproof package according to claim 1, wherein the sliding element can be pulled out of the package housing by exerting a pressure against the elastic force of the at least one spring element in a transverse direction of the package and by simultaneously pulling the sliding element in an opening direction.

3. The childproof package according to claim 2, wherein at least one opening is provided in a long side of the package housing.

4. The childproof package according to claim 2, wherein at least one press-in spot is formed in a long side of the package housing.

5. The childproof package according to claim 1, wherein the at least one spring element is arranged on one side of the sliding element.

6. The childproof package according to claim 1, the childproof package comprising two spring elements.

7. The childproof package according to claim 6, wherein the childproof package comprises two guide recesses, and wherein the sliding element comprises two projections.

8. The childproof package according to claim 7, wherein the projections are arranged with an offset from each other in an opening direction of the sliding element.

9. The childproof package according to claims 6, the childproof package comprising two openings or press-in spots, which can be pressed simultaneously or in sequence to release the sliding element.

10. The childproof package according to claim 1, wherein the package housing is formed out of cardboard, molded film, injection-molded plastic, or foam material.

11. The childproof package according to claim 1, wherein the sliding element is formed out of cardboard, molded film, injection-molded plastic, or foam material.

12. The childproof package according to claim 1, wherein the at least one guide recess is formed in an insert arranged in the package housing.

13. The childproof package according to claim 1, wherein the at least one guide recess is integrated into a bottom or top area of the package housing.

14. The childproof package according to claim 1, wherein the sliding element is designed as a drawer, and wherein the package content is a heat-sealed blister pack.

15. The childproof package according to claim 1, wherein the sliding element is designed as a blister pack, and wherein the package content consists of tablets.

* * * * *